US012709849B2

(12) United States Patent
Warfield et al.

(10) Patent No.: US 12,709,849 B2
(45) Date of Patent: Aug. 18, 2026

(54) METHOD AND ARTICLE OF LOCATING BRINE NOZZLE FOR SPREADER FOR CONVENIENT SERVICING

(71) Applicant: Buyers Products Company, Mentor, OH (US)

(72) Inventors: Jeffery S. Warfield, Chardon, OH (US); Michael L. Davis, Jr., Painesville, OH (US)

(73) Assignee: Buyers Products Company, Mentor, OH (US)

( * ) Notice: Subject to any disclaimer, the term of this patent is extended or adjusted under 35 U.S.C. 154(b) by 270 days.

(21) Appl. No.: 18/456,077

(22) Filed: Aug. 25, 2023

(65) Prior Publication Data

US 2025/0067012 A1 Feb. 27, 2025

(51) Int. Cl.
*E01H 10/00* (2006.01)

(52) U.S. Cl.
CPC ..... *E01H 10/007* (2013.01)

(58) Field of Classification Search
CPC ..... E01H 10/007; B05B 7/24; B01F 23/565
See application file for complete search history.

(56) References Cited

U.S. PATENT DOCUMENTS 3,171,558 A * 3/1965 Sharp ..... B60P 1/40 414/505
3,705,693 A * 12/1972 Franz ..... B05B 1/10 239/602
4,072,772 A * 2/1978 Franz ..... B05B 13/0207 427/299
4,670,302 A * 6/1987 Oldemeyer ..... B27N 1/029 118/679
5,866,201 A * 2/1999 Blue ..... B01J 2/10 427/430.1
5,988,535 A * 11/1999 Kime ..... E01H 10/007 239/650
6,328,798 B1 * 12/2001 Bostrom ..... B29B 7/94 118/24
6,446,879 B1 * 9/2002 Kime ..... E01C 19/203 239/7
6,551,401 B1 * 4/2003 Winistorfer ..... B01F 27/2123 366/244
10,960,363 B2 * 3/2021 Hildreth ..... B01F 21/15
11,530,138 B1 * 12/2022 Debro ..... C02F 1/006
11,731,088 B2 * 8/2023 Hildreth ..... C09K 3/185 422/261
11,969,698 B2 * 4/2024 Hildreth ..... F04D 27/004
2009/0032624 A1 * 2/2009 Truan ..... E01H 10/007 239/675

(Continued)

FOREIGN PATENT DOCUMENTS

FR 3092559 A1 8/2020
JP 4338723 B2 10/2009
JP 2020080838 A 6/2020

*Primary Examiner* — Joseph A Greenlund
(74) *Attorney, Agent, or Firm* — Emerson, Thomson & Bennett, LLC; Roger D. Emerson; Allison V. Trimble

(57) ABSTRACT

A hopper for a spreader system for applying salt to a roadway surface, which hopper includes a hopper body for containing salt, at least one auger for displacing salt, a brine nozzle for dispensing brine solution into the hopper body, and a removability mechanism for easy mounting, attachment, and removal of the brine nozzle into the hopper body bottom panel.

8 Claims, 5 Drawing Sheets

(56) References Cited

U.S. PATENT DOCUMENTS

| | | | | |
|---|---|---|---|---|
| 2009/0090796 | A1* | 4/2009 | Tian | G05D 7/0113 239/533.13 |
| 2013/0099155 | A1* | 4/2013 | Nesheim | B01F 21/221 422/275 |
| 2014/0251177 | A1* | 9/2014 | Nesheim | B01F 21/221 366/132 |
| 2017/0080446 | A1* | 3/2017 | Roller | B05B 13/0257 |
| 2019/0329191 | A1* | 10/2019 | Hildreth | B01F 21/30 |
| 2021/0123200 | A1* | 4/2021 | Firth | E01H 10/007 |
| 2022/0192222 | A1* | 6/2022 | Lagally | B01F 27/50 |
| 2022/0228463 | A1 | 7/2022 | Samuelson et al. | |
| 2023/0182179 | A1* | 6/2023 | Cullen | B08B 3/02 134/37 |
| 2023/0304243 | A1* | 9/2023 | Iverson | B01F 35/81 |
| 2023/0321681 | A1* | 10/2023 | Heinen | A01C 15/006 239/662 |
| 2023/0405618 | A1* | 12/2023 | Huber | B05B 13/069 |
| 2024/0301643 | A1* | 9/2024 | Mäenpää | E01H 10/007 |
| 2024/0390924 | A1* | 11/2024 | Jayaraman | B05B 7/0483 |
| 2025/0067012 | A1* | 2/2025 | Warfield | E01H 10/007 |

* cited by examiner

METHOD AND ARTICLE OF LOCATING BRINE NOZZLE FOR SPREADER FOR CONVENIENT SERVICING

I. BACKGROUND

The present disclosure pertains to the art of road winter treatment, particularly salt-spreading vehicles. Specifically, this disclosure teaches a removable brine nozzle attachment, which is accessible from the underside of a truck hopper body, that facilitates safe and efficient cleaning of the nozzle.

Roads in winter are often prone to freezing in harsh, frigid conditions. If left untreated, these icy conditions can lead to road hazards and accidents as vehicles are at greater risk of losing control. Salt-spreading devices have been employed for many years to alleviate these issues. Particularly, large trucks are often used as salt-spreading vehicles. These vehicles generally include a hopper body containing salt. A brine solution is then dispensed into the hopper body and mixed with the salt. Augers within the hopper body push the resulting mixture towards the back end of the body, which mixture is then spread en masse across roadways and paved drives.

These vehicles must be maintained and cleaned. Over the course of the vehicle's use, the augers, hopper body, and brine-injecting nozzle accumulate grime, corrosion, and wear that must be cleaned and managed to ensure the vehicle's continued operation. Particularly, the brine nozzle can become choked with dried and clotted brine-salt solution.

While the hopper body and augers can be cleaned using a high-pressure hose and water, the brine nozzle is a more intricate piece that must be cleaned by hand. Typically, the nozzle is located on the bottom of the hopper body, as it sprays brine up from beneath the salt. The augers are located within the hopper body and run along its length. The whole system is, generally, compact.

Currently, the method of cleaning the brine nozzle involves a worker reaching into the hopper body to access the nozzle from above. They must reach through the close spaces between the augers and clean out the clogs from the brine nozzle. The worker then signals to another to check the nozzle, and a switch is flipped which sprays a small quantity of brine, to confirm the solution is flowing.

There are risks associated with reaching some, or all, of a body part into the hopper body, between the augers. If the incorrect switch is flipped, the augers could engage, posing a safety hazard to the worker. It is also generally an uncomfortable method of climbing up to the hopper body, stretching to reach into the body, cleaning and waiting for the brine nozzle check, and extricating oneself from the body to return to solid ground. Thus, the current method of cleaning the brine nozzle of a salt-spreading vehicle is both uncomfortable and unsafe. Generally, the nozzle is welded, bolted, or otherwise secured to the bottom of the hopper body, with the only removable component being a valve connection between the nozzle and the hose through which the brine solution flows. The nozzle itself is typically not separable from the hopper body.

The present invention remedies the above issues by introducing a removable brine nozzle that can separate from the hopper body. The removability mechanism described herein is located on the underside of the hopper body. Workers can then avoid having to reach in between the augers within the hopper body, instead accessing the nozzle from beneath the body to be cleaned and checked. This method also allows for more efficient, less uncomfortable, brine nozzle cleaning.

Overall, the invention described allows an operator to clean the brine nozzle of a salt-spreading vehicle more easily and safely than current practices. The invention resolves these issues by incorporating a system for access to the nozzle from the underside of the hopper body.

II. SUMMARY

In accordance with one aspect of the present invention, a hopper for a spreader system for applying salt to a roadway surface, comprising a hopper body comprising an enclosure for receiving and retaining the salt, wherein the hopper body further comprises a bottom panel having an exterior surface and an interior surface, at least one auger for displacing the salt for application to the roadway, wherein the at least one auger is mounted in the hopper body at a position proximate to the interior surface of the bottom panel, a brine nozzle for dispensing a brine solution into the hopper and which has an exterior surface, and a removability mechanism for mounting the brine nozzle into the bottom panel so that the brine nozzle extends into the hopper body at a position adjoining the at least one auger, wherein the removability mechanism is attached to the exterior surface of the bottom panel for easy attachment and removal from the hopper body.

In accordance with another aspect of the present invention, a hopper with a removability mechanism further comprising a threaded port located on the exterior surface of the hopper body bottom panel, the port having a circular flange extending perpendicularly outward from the exterior surface of the hopper body bottom panel, wherein the circular flange has interior and exterior surfaces and threads along the length of the flange interior surface, and there are threads located on the brine nozzle exterior surface, which correspond to the threads along the length of the flange interior surface, such that the brine nozzle is capable of being securely screwed and tightened into the port.

In accordance with another aspect of the present invention, a hopper with a removability mechanism, as described above, wherein the removability mechanism may further include an adapter having a threaded adapter hole, a threaded adapter surface, a topside end, and an underside end. The threaded adapter hole and threaded adapter surface may be disposed on the topside end, and the brine nozzle may be capable of being securely screwed and tightened into the threaded adapter hole.

In accordance with another aspect of the present invention, a hopper, wherein the removability mechanism further comprises a sealed port located on the exterior surface of the hopper body bottom panel, said port having a circular flange extending perpendicularly outward from the exterior surface of the hopper body bottom panel. The circular flange has interior and exterior surfaces and possesses a through-hole from an exterior surface of the flange to the opposite side flange exterior surface, and a similar through-hole extends from an exterior surface of the brine nozzle to the opposite side brine nozzle exterior surface. The brine nozzle can be inserted into the port in such a way that through-holes located on the port and brine nozzle align, and a pin can be inserted into the aligned through-holes to securely fasten the brine nozzle into the sealed port. Further, a shelf along the interior surface of the circular flange, located at the point where the removability mechanism connects to the exterior surface of the hopper body bottom panel, would have a rubber ring that rests flush with the shelf in a direction outwardly extending from exterior surface of the hopper body bottom panel. The brine nozzle is in contact with the rubber ring, and at the point of contact between the brine nozzle and the rubber ring, the through-holes in the brine nozzle and the sealed port are misaligned, such that when the holes are aligned and the pin inserted, the brine nozzle depresses the rubber ring.

In accordance with another aspect of the present invention, a hopper, wherein the removability mechanism further comprises a sealed port located on the exterior surface of the hopper body bottom panel, said port having a circular collet having metal teeth. The port also has one or more O-rings and a locking mechanism within the port. The brine nozzle can be pressed into the sealed port.

In accordance with another aspect of the present invention, a hopper for a spreader system for applying salt to a roadway surface, comprising a hopper body comprising an enclosure for receiving and retaining the salt, wherein the hopper body further comprises a bottom panel having an exterior surface and an interior surface. The hopper body contains at least one auger for displacing the salt for application to the roadway, wherein the at least one auger is mounted in the hopper body at a position proximate to the interior surface of the bottom panel. The hopper also contains a brine nozzle for dispensing a brine solution into the hopper and which has an exterior surface and a removability mechanism for mounting the brine nozzle into the bottom panel so that the brine nozzle extends into the hopper body at a position adjoining the at least one auger, wherein the removability mechanism is attached to the exterior surface of the bottom panel for easy attachment and removal from the hopper body. The removability mechanism comprises a threaded port located on the exterior surface of the hopper body bottom panel, having a circular flange extending perpendicularly outward from the exterior surface of the hopper body bottom panel. The circular flange has interior and exterior surfaces and threads along the length of the flange interior surface. Threads are also located on the brine nozzle exterior surface, which correspond to the threads along the length of the flange interior surface, such that the brine nozzle is capable of being securely screwed and tightened into the port. There is a shelf along the interior surface of the circular flange, which shelf is located at the point where the removability mechanism connects to the exterior surface of the hopper body bottom panel. The removability mechanism can further comprise a teflon tape sealant for coating the threads located on the brine nozzle exterior surface and a rubber ring that rests flush with the shelf along the interior surface of the circular flange, in a direction outwardly extending from exterior surface of the hopper body bottom panel.

In accordance with another aspect of the present invention, a method for servicing a spreader system hopper for applying salt to a roadway surface, involving the following steps: accessing a removability mechanism configured onto an underside of the hopper, disengaging the removability mechanism from the underside of the hopper, removing the brine nozzle from a port on the hopper body bottom panel, cleaning the brine nozzle, replacing the brine nozzle into the port on the hopper body bottom surface, and reengaging the mechanism onto the underside of the hopper. The mechanism could also be accessed from the underside of the hopper body.

Still other benefits and advantages of the invention will become apparent to those skilled in the art to which it pertains upon a reading and understanding of the following detailed specification.

III. BRIEF DESCRIPTION OF THE FIGURES

The above drawings form part of the disclosure and specification and are included to further demonstrate certain aspects of the invention, which aspects will be described in detail later in this specification. The invention may be better understood by reference to these drawings in conjunction with the detailed description.

FIGS. 5A, 5B, 5C, and 5D are perspective, bottom, top, and side views of an adapter removability mechanism, respectively.

IV. DETAILED DESCRIPTION

Figure 1:
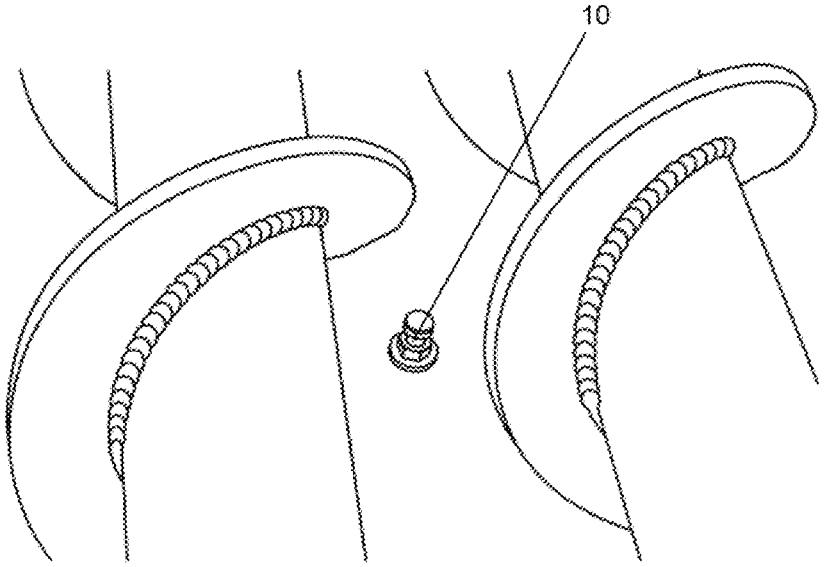
FIG. 1 is a top view of the hopper body.

Referring now to the drawings, wherein the showings are for purposes of illustrating embodiments of the invention only and not for purposes of limiting the same, and wherein like reference numerals are understood to refer to like components, FIG. 1 shows the fully assembled hopper and spreader system for applying salt to a roadway surface.

Figure 2:
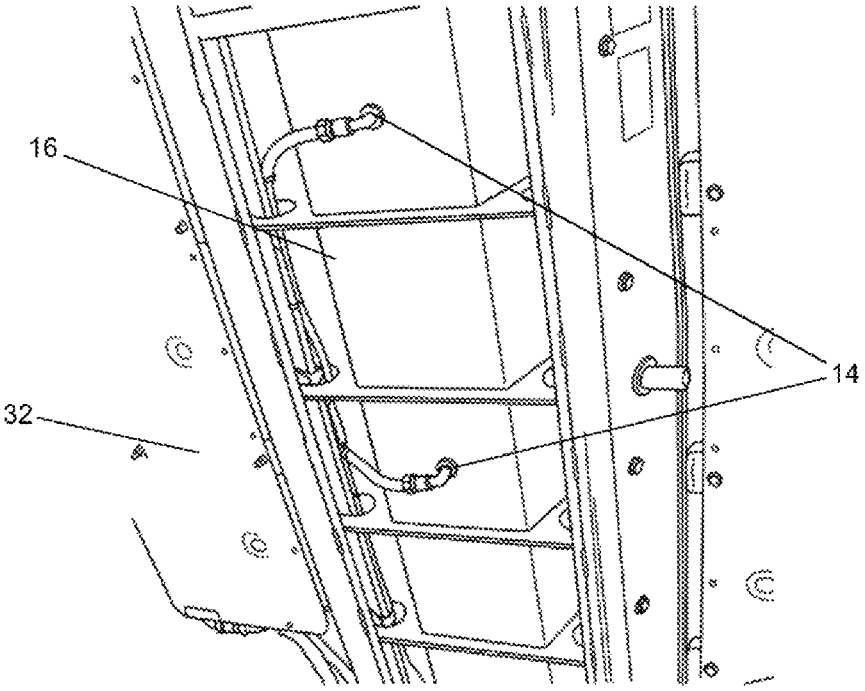
FIG. 2 is a bottom view of the hopper body.
Figure 3:
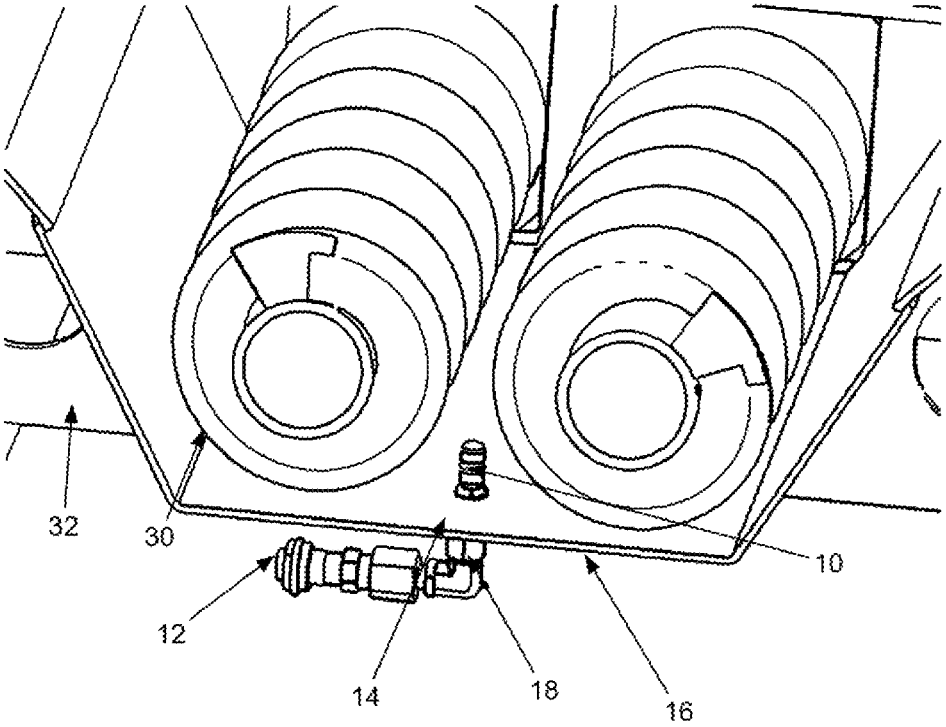
FIG. 3 is a cut-away perspective view of the hopper body, showing the brine nozzle installed.
Figure 4:
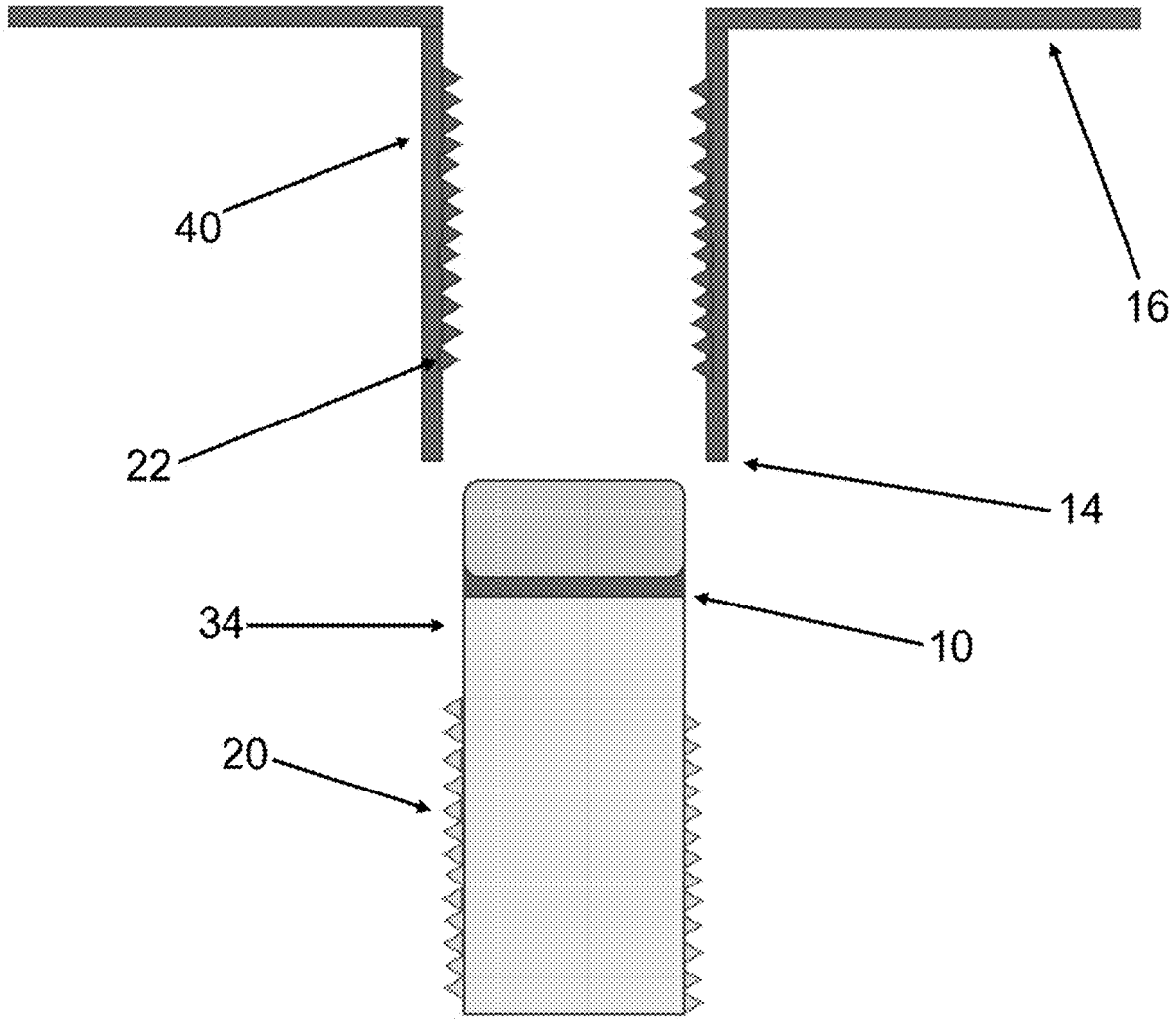
FIG. 4 is a side view of a threaded screw removability mechanism.
Figure 5A:
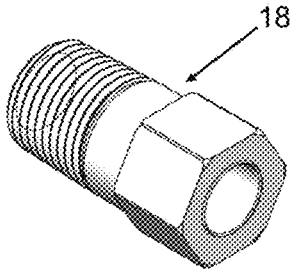
Figure 5D:
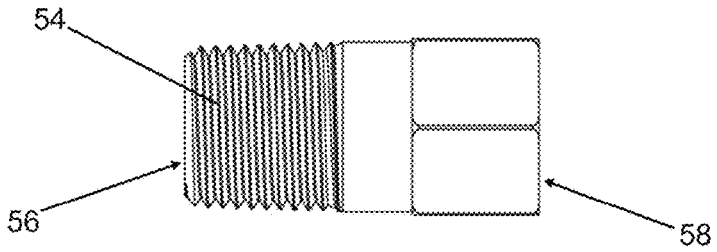
Figure 5B:
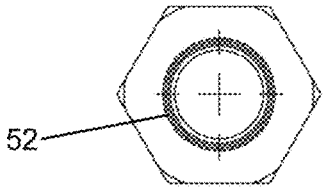
Figure 5C:
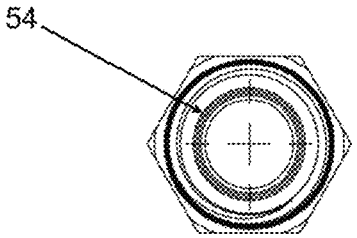

With reference to FIGS. 1, 2, and 3, the system is mostly enclosed by the hopper body 32, which includes an enclosure for receiving and retaining the salt and has a bottom panel 16 having an exterior and an interior surface. The augers 30 displace the salt for application to the roadway and are mounted in the hopper body 32 at a position proximate to the interior surface of the bottom panel 16 of the hopper body 32; the figure here shows two mounted augers 30. The brine nozzle 10 dispenses a brine solution into the hopper body 32 and has an exterior surface 34 (FIG. 4). The brine nozzle 10 is connected to the brine solution tanks through the hose 12 and feeds through a port or similar opening 14 in the hopper body 32. The brine nozzle 10 disclosed in this system would be removable; thus, the brine nozzle 10 itself ideally should not be permanently secured to the hopper body 32. A removability mechanism for mounting the brine nozzle 10 into the bottom panel 16 situates the brine nozzle 10 as the brine nozzle 10 extends into the hopper body 32 at a position adjoining the auger(s) 30. The removability mechanism then engages to secure the brine nozzle 10 in place, but the mechanism should also be capable of disengagement, such that the brine nozzle 10 may be removed from the port or opening 14 for servicing and cleaning. The removability mechanism is attached to the exterior surface of the bottom panel 16 for easy attachment and removal from the hopper body 32.

With reference to FIGS. 4, 5A, 5B, 5C, and 5D, the removability mechanism can include any apparatus which facilitates easy engagement and disengagement, locking and unlocking, clipping and unclipping, etc. Examples of such mechanisms include, but should not be limited to, those discussed here. A threaded screw mechanism, pin-secured mechanism, or push-fit fitting could all serve the purpose of easy servicing and cleaning. FIG. 4 shows one such mechanism as a threaded screw system. A threaded port 14 is located on the exterior surface of the hopper body bottom panel 16. The port has a circular flange 40 extending perpendicularly outward from the exterior surface of the hopper body bottom panel 16, which circular flange 40 may have interior and exterior surfaces. Threads 22 run along the length of the flange interior surface. The brine nozzle 10 possesses corresponding threads 20 along its exterior surface 34 that engage with—and can be screwed and tightened into—the matching threads 22 along the inside surface of the threaded port 14 on the hopper body bottom panel 16. The removability mechanism might also include an adapter 18 having an inner, threaded adapter hole 52, an outer, threaded adapter surface 54, a topside end 56, and an underside end 58. The adapter hole 52 and adapter surface 54 may both be disposed on the topside end 56 of the adapter 18. The brine nozzle 10 may screw into the adapter hole 52.

Further, the threaded screw mechanism could possess a shelf along the interior surface of the circular flange 40, which shelf would be located at the point where the removability mechanism connects to the exterior surface of the hopper body bottom panel 16. A rubber ring can rest flush with the shelf along the interior surface of the circular flange, in a direction outwardly extending from exterior surface of the hopper body bottom panel 16, and a teflon tape sealant could coat the threads 20 located on the brine nozzle exterior surface 34.

This disclosure also contemplates a pin-secured removability mechanism. This removability mechanism would include a sealed port located on the exterior surface of the hopper body bottom panel. Similarly to the threaded screw mechanism, the port would have a circular flange 40 extending perpendicularly outward from the exterior surface of the hopper body bottom panel 16, which circular flange has interior and exterior surfaces. This mechanism, however, possesses a through-hole from an exterior surface of the flange to the opposite side flange exterior surface. Another through-hole extends from an exterior surface of the brine nozzle 10 to the opposite side brine nozzle exterior surface, and the brine nozzle 10 can be inserted into the port in such a way that through-holes located on the port and brine nozzle 10 align. A pin can be inserted into the aligned through-holes to securely fasten the brine nozzle 10 into the sealed port.

Further, the pin-secured mechanism could possess a shelf along the interior surface of the circular flange 40, which shelf would be located at the point where the removability mechanism connects to the exterior surface of the hopper body bottom panel 16. A rubber ring can rest flush with the shelf along the interior surface of the circular flange 40, in a direction outwardly extending from exterior surface of the hopper body bottom panel 16. In accordance with the use of a rubber O-ring, the pin-secured mechanism could also situate the brine nozzle 10 in contact with the rubber ring. At the point of contact between the brine nozzle 10 and the rubber ring, the through-holes in the brine nozzle and the sealed port are misaligned, such that when the holes are aligned and the pin inserted, the brine nozzle 10 depresses the rubber ring.

This disclosure also contemplates a push-fit removability mechanism. This removability mechanism would include a sealed, push-fit port located on the exterior surface of the hopper body bottom panel 16. The push-fit fitting on the port includes a circular collet with metal teeth, one or more O-rings, and a locking mechanism within the port. The brine nozzle 10 can then be pressed into the push-fit sealed port.

The brine nozzle system disclosed, particularly the removability mechanism, should be accessible from the outside of the hopper body 32. The operator can thus engage and disengage the mechanism, remove and service the brine nozzle 10, and replace the brine nozzle without reaching their hands between the auger(s) 30 within the hopper body 32.

Specifically, operation of the removability mechanism involves the process of accessing a removability mechanism configured onto an underside of the hopper, disengaging the removability mechanism from the underside of the hopper, removing the brine nozzle 10 from a port on the hopper body bottom panel 16, cleaning the brine nozzle 10, replacing the brine nozzle 10 into the port 14 on the hopper body bottom surface, and reengaging the mechanism onto the underside of the hopper.

Given that the brine solution dispensed by the brine nozzle is mostly liquid, the removability mechanism benefits from a sealant (as seen in several of the above aspects), to prevent leakage of the solution. Contemplated here are rubber O-rings, glues, gaskets, and teflon tape, but any material that can sufficiently seal against escaping liquids could be used in application of this invention.

Having thus described the invention, it is now claimed:

We claim:

1. A hopper for a spreader system for applying salt to a roadway surface, comprising:

a hopper body comprising an enclosure for receiving and retaining the salt, wherein the hopper body further comprises a bottom panel having an exterior surface and an interior surface;

at least one auger for displacing the salt for application to the roadway, wherein the at least one auger is mounted in a bottom portion within the hopper body;

a brine nozzle for dispensing a brine solution into the hopper and which has an exterior surface; and a removability mechanism for mounting the brine nozzle into the bottom panel so that the brine nozzle extends into the hopper body at a position adjoining the at least one auger, wherein the removability mechanism is attached to the exterior surface of the bottom panel, the removability mechanism including a sealed port located on the exterior surface of the hopper body bottom panel, said sealed port having a circular flange extending perpendicularly outward from the exterior surface of the hopper body bottom panel, the circular flange having interior and exterior surfaces and possessing a through- hole from an exterior surface of the flange to the opposite side flange exterior surface, a through-hole which extends from an exterior surface of the brine nozzle to the opposite side brine nozzle exterior surface, wherein the brine nozzle can be inserted into the sealed port in such a way that through-holes located on the sealed port and brine nozzle align, and a pin which can be inserted into the aligned through-holes to securely fasten the brine nozzle into the sealed port.

2. The hopper of claim 1, wherein the removability mechanism further comprises:

a shelf along the interior surface of the circular flange;

said shelf located at the point where the removability mechanism connects to the exterior surface of the hopper body bottom panel; and a rubber ring that rests flush with the shelf in a direction outwardly extending from exterior surface of the hopper body bottom panel.

3. The hopper of claim 2, wherein the removability mechanism further comprises:

the brine nozzle in contact with the rubber ring; and at the point of contact between the brine nozzle and the rubber ring, the through-holes in the brine nozzle and the sealed port are misaligned, such that when the holes are aligned and the pin inserted, the brine nozzle depresses the rubber ring.

4. The hopper of claim 1, wherein the removability mechanism further comprises:

the sealed port located on the exterior surface of the hopper body bottom panel;

said sealed port having a circular collet having metal teeth;

the sealed port also having one or more O-rings;

a locking mechanism within the sealed port; and wherein the brine nozzle can be pressed into the sealed port.

5. The hopper of claim 1, wherein the removability mechanism further comprises:

an adapter having a threaded adapter hole, a threaded adapter surface, a topside end, and an underside end;

wherein the threaded adapter hole and threaded adapter surface are disposed on the topside end; and wherein the brine nozzle is capable of being securely screwed and tightened into the threaded adapter hole.

6. A method for servicing a spreader system hopper for applying salt to a roadway surface, comprising:

accessing a removability mechanism configured onto an underside of the hopper, the removability mechanism further including, a sealed port located on the underside of the hopper, said sealed port having a circular flange extending perpendicularly outward from the hopper, the circular flange having interior and exterior surfaces and possessing a through-hole from an exterior surface of the flange to the opposite side flange exterior surface, a through-hole which extends from an exterior surface of a brine nozzle to the opposite side brine nozzle exterior surface, wherein the brine nozzle can be inserted into the sealed port in such a way that through-holes located on the sealed port and brine nozzle align, and a pin which can be inserted into the aligned through-holes to securely fasten the brine nozzle into the sealed port;

disengaging the removability mechanism from the underside of the hopper;

removing the brine nozzle from a sealed port on the hopper body bottom panel;

cleaning the brine nozzle;

replacing the brine nozzle into the sealed port on the hopper body bottom surface; and reengaging the mechanism onto the underside of the hopper.

7. The method of claim 6 wherein the mechanism is accessed from the exterior surface of the hopper body bottom panel.

8. The method of claim 6, wherein the removability mechanism further comprises:

an adapter having a threaded adapter hole, a threaded adapter surface, a topside end, and an underside end;

wherein the threaded adapter hole and threaded adapter surface are disposed on the topside end; and wherein the brine nozzle is capable of being securely screwed and tightened into the threaded adapter hole.

* * * * *